US005783782A

United States Patent [19]

Sterrett et al.

[11] Patent Number: 5,783,782

[45] Date of Patent: Jul. 21, 1998

[54] MULTI-CHAMBER MUFFLER WITH SELECTIVE SOUND ABSORBENT MATERIAL PLACEMENT

[75] Inventors: Dale E. Sterrett, Grass Lake; Eric C. Pekrul, Mason; Thomas P. Turner, Jackson, all of Mich.

[73] Assignee: Tenneco Automotive Inc., Lake Forest, Ill.

[21] Appl. No.: 740,415

[22] Filed: Oct. 29, 1996

[51] Int. Cl.[6] ..... F01N 1/08

[52] U.S. Cl. ..... 181/272; 181/256

[58] Field of Search ..... 181/252, 255, 181/256, 257, 258, 264, 265, 266, 269, 272, 273, 282

[56] References Cited

U.S. PATENT DOCUMENTS

| | | | |
|---|---|---|---|
| 1,988,048 | 1/1935 | Peik . | |
| 2,014,666 | 9/1935 | Peik . | |
| 2,072,961 | 3/1937 | Nelson . | |
| 2,101,460 | 12/1937 | Schmidt | 181/256 |
| 2,144,725 | 1/1939 | Manning . | |
| 2,166,417 | 7/1939 | Manning . | |
| 2,205,899 | 6/1940 | Chipley . | |
| 2,834,425 | 5/1958 | Rawson . | |
| 2,984,315 | 5/1961 | Kleinecke . | |
| 3,512,607 | 5/1970 | Hubbell . | |
| 3,771,315 | 11/1973 | Scott . | |
| 3,966,016 | 6/1976 | Hecht . | |
| 4,109,755 | 8/1978 | Grueneberg . | |
| 4,124,092 | 11/1978 | Kajiya et al. . | |
| 4,192,401 | 3/1980 | Deaver et al. | 181/266 |
| 4,235,304 | 11/1980 | Suyama . | |
| 4,467,887 | 8/1984 | Vizard . | |
| 4,577,724 | 3/1986 | Vizard . | |
| 4,580,656 | 4/1986 | Fukuda . | |
| 4,589,517 | 5/1986 | Fukuda . | |
| 4,598,790 | 7/1986 | Uesugi et al. . | |
| 4,673,058 | 6/1987 | Roberts et al. . | |
| 4,700,805 | 10/1987 | Tanaka et al. . | |
| 4,700,806 | 10/1987 | Harwood . | |
| 4,736,817 | 4/1988 | Harwood . | |
| 4,846,302 | 7/1989 | Hetherington . | |
| 4,848,513 | 7/1989 | Csaszar | 181/265 |
| 4,913,260 | 4/1990 | Fallon . | |
| 4,930,597 | 6/1990 | Udell . | |
| 4,971,166 | 11/1990 | Hase . | |
| 5,025,890 | 6/1991 | Hisashige et al. . | |
| 5,048,287 | 9/1991 | Howe et al. . | |
| 5,183,977 | 2/1993 | Horitani . | |
| 5,200,582 | 4/1993 | Kraai, Jr. et al. | 181/256 |
| 5,227,593 | 7/1993 | Takahashi et al. . | |

*Primary Examiner*—Khanh Dang
*Attorney, Agent, or Firm*—Harness, Dickey & Pierce, P.L.C.

[57] ABSTRACT

The present invention provides an acoustic muffler for attenuating sound waves of the exhaust gas of an internal combustion engine including a shell, a plurality of walls closing both ends of the shell and dividing an interior of the shell into a plurality of chambers. The plurality of chambers include a first chamber having a sound absorbing material disposed therein. An imperforate pipe extends between the walls of the first chamber. Preferably, the plurality of chambers also include a second and a third chamber communicating with the imperforate pipe. Furthermore, a fourth chamber communicates with the second chamber.

13 Claims, 4 Drawing Sheets

MULTI-CHAMBER MUFFLER WITH SELECTIVE SOUND ABSORBENT MATERIAL PLACEMENT

BACKGROUND OF THE INVENTION

1. Technical Field

The present invention relates generally to an engine exhaust apparatus having a sound attenuating muffler for damping exhaust gas noises.

2. Discussion

In order to reduce sounds of exhaust gasses from an engine, a muffler is generally incorporated into an automobile exhaust system to limit the pressure level of exhaust noise produced by engine operation. There are two general classifications of mufflers, reactive and dissipative. Reactive mufflers are generally composed of a number of resonating chambers of different volumes and shapes connected with pipes. Reactive mufflers often include baffles or flow-reversals. However, these configurations produce a relatively high pressure drop, causing a back pressure at the exhaust of the engine, thus restricting engine performance.

Dissipative mufflers are usually composed of ducts or chambers which are filled with acoustic absorbing materials such as fiberglass, steel wool, or a porous ceramic. These materials absorb the acoustic energy and transform it into thermal energy. Unfortunately, the sound absorbing material in dissipative mufflers tends to break down because of the structure of the material and the high velocity and temperature of the exhaust.

The sounds or noises of the gasses generated from operation of the engine are also generally known to be reduced by passage of the exhaust gasses through a plurality of small holes of an elimination chamber so that the gasses react to lower their sound level. Expansion chambers are also utilized in mufflers by introducing the exhaust gasses into a chamber where they are expanded and then emitted or passed along to further muffler chambers. Mufflers consisting of a combination of some of the above are known in the art in a variety of configurations.

However, the prior art muffler systems generally fail to attenuate sound waves over a broad band of frequencies. Mufflers typically provide effective attenuation only at specified frequencies equal to or greater than a specific cut-off frequency. The transmission loss or effectiveness under ideal conditions, of a typical dissipative muffler is generally an inclined straight line with respect to frequency, and provides effective attenuation only above approximately 500 hertz. As a result, the typical dissipative muffler fails to attenuate low frequency sound. This failure is unacceptable in an automobile exhaust muffler because the sound produced by the engine has greatest amplitude at lower frequencies, such as approximately 500 hertz.

The transmission loss of a typical reactive muffler or expansion can is generally a periodic series of sinusoidal "humps." As a result, a reactive muffler provides acceptable amplitude levels of low frequency attenuation, but exhibits a series of "zero frequencies" where the muffler provides no attenuation.

Accordingly, it is desirable to combine the acoustic performance of both types of mufflers to achieve broad band low frequency attenuation in a low back pressure muffler.

SUMMARY OF THE INVENTION

The present invention provides an acoustic muffler for attenuating sound waves of the exhaust gas of an internal combustion engine including a shell, a plurality of walls closing both ends of the shell and dividing an interior of the shell into a plurality of chambers. The plurality of chambers include a first chamber having a sound absorbing material disposed therein. An imperforate pipe extends between the walls of the first chamber. Preferably, the plurality of chambers also include a second and third chamber communicating with the imperforate pipe. Furthermore, a fourth chamber communicates with the second chamber.

BRIEF DESCRIPTION OF THE DRAWINGS

In order to appreciate the manner in which the advantages and objects of the invention are obtained, a more particular description of the invention will be rendered by reference to specific embodiments thereof which are illustrated in the appended drawings. Understanding that these drawings only depict preferred embodiments of the present invention and are not therefore to be considered limiting in scope, the invention will be described and explained with additional specificity and detail through the use of the accompanying drawings in which.

DETAILED DESCRIPTION OF THE PREFERRED EMBODIMENTS

The following description of the preferred embodiments is merely exemplary and is in no way intended to limit the invention, its application or its uses.

Figure 1:
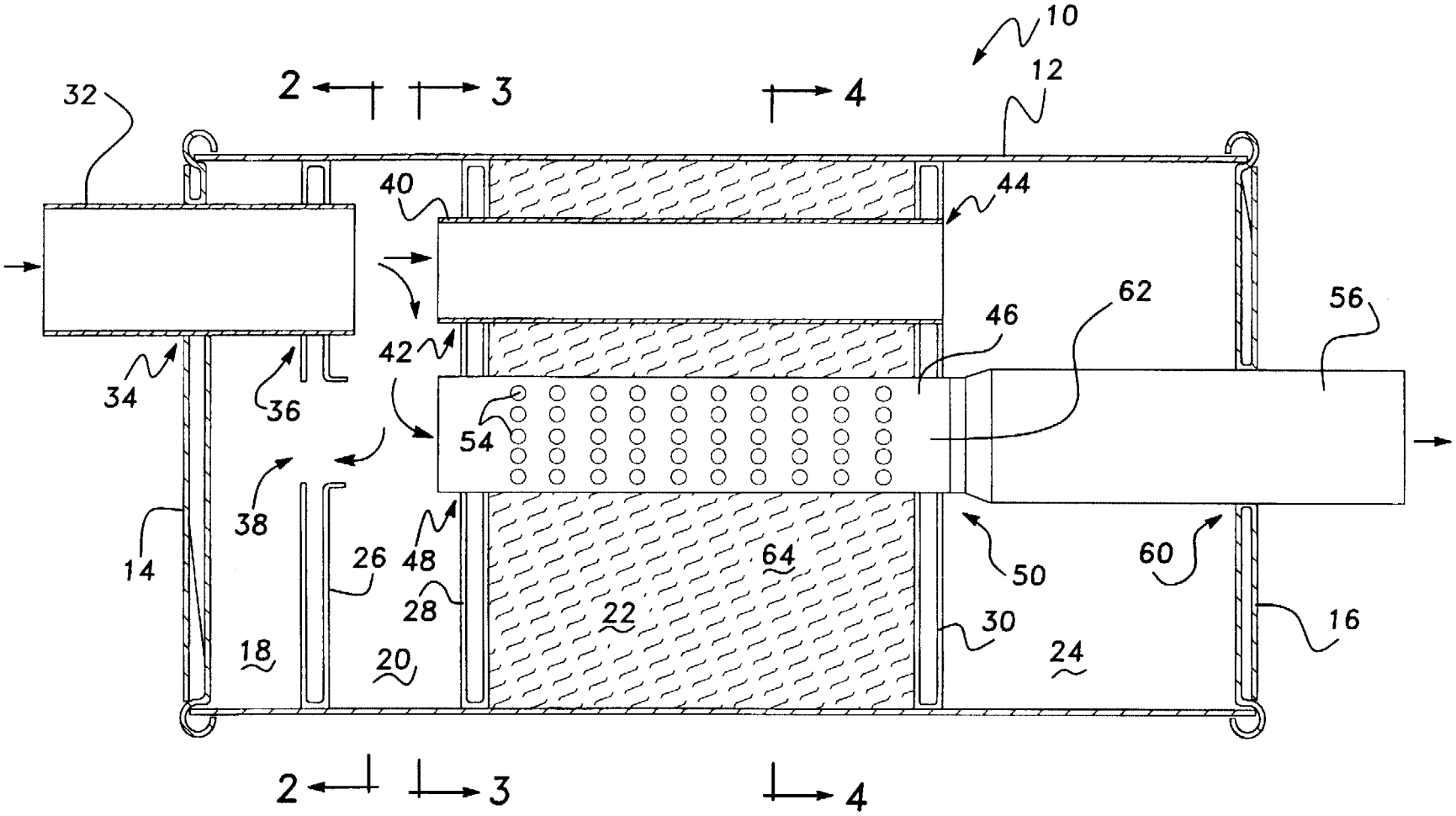
FIG. 1 is a top view of a muffler in cross-section including a attenuating chamber having a sound-absorbing material disposed therein and an imperforate pipe extending thereacross.

Referring to the drawings, FIG. 1 shows a muffler 10 which is connected to an exhaust pipe of an internal combustion engine by a coupling means (not shown). The exhaust fluid, normally air and other exhaust gasses, flowing through the exhaust pipe carries sound waves generated during operation of the engine. The majority of the sound waves are considered undesirable noise which is to be muffled.

FIG. 1 shows a muffler 10 having a cell defined by a cylindrical shell 12 preferably having an oval cross-section, front end plate 14, and rear end plate 16. The inside of the cell is divided into a plurality of chambers by a plurality of partition walls. The plurality of chambers include a tuning chamber 18, an expansion chamber 20, an attenuating chamber 22, and a second tuning chamber 24. The plurality of partition walls include the first partition wall 26, the second partition wall 28, and the third partition wall 30.

The first partition wall 26 cooperates with the shell 12 and the front end plate 14 to define the boundaries of the first tuning chamber 18. The first tuning chamber 18 has a volume ranging from 1.1 to 3.3 liters and is preferably 1.5 liters. The first partition wall 26 cooperates with the shell 12 and the second partition wall 28 to define the expansion chamber 20. The expansion chamber 20 has a variable volume but is preferably about 1.7 liters. The second partition wall cooperates with the shell 12 and the third partition wall 30 to define the attenuating chamber 22. The attenuating chamber 22 has a volume ranging from 2.1 to 8.2 liters and is preferably 4.5 liters. The third partition wall 30 cooperates with the shell 12 and the rear end plate 16 to define the second tuning chamber 24. The second tuning chamber 24 has a variable volume but is preferably 3.0 liters.

An inlet pipe or conduit 32 is supported by the front end plate 14 and the first partition wall 26. This is accomplished by inserting the inlet conduit 32 through a front end plate inlet aperture 34 and a first partition wall inlet aperture 36. The inlet conduit 32 may be spot welded or otherwise secured to the front end plate 14 and/or first partition wall 26 by conventional means. In order to introduce exhaust gasses into the expansion chamber 20, the inlet conduit 32 opens directly into the expansion chamber 20 beyond the first tuning chamber 18.

Figure 2:
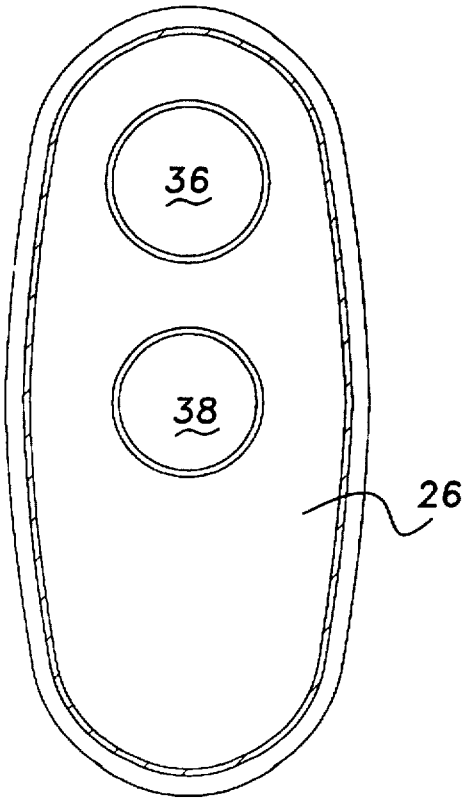
FIG. 2 is a sectional view taken along line 2—2 of FIG. 1.

As best seen in FIG. 2, the first partition wall 26 also includes a first partition wall passage 38. The first partition wall passage 38 permits fluid communication between the tuning chamber 18 and the expansion chamber 20. It should be noted that the axial dimension of the first partition wall passage 38 can be extended beyond the width of the first partition wall 26 to obtain a desired frequency response from the tuning chamber 18.

In order to transfer the exhaust gasses from the expansion chamber 20, an imperforate conduit 40 is passed through a second partition wall imperforate conduit aperture 42 and a third partition wall imperforate conduit aperture 44. The imperforate conduit 40 is supported by the second partition wall 28 and the third partition wall 40 such that it extends through the attenuating chamber 22 and opens directly into the second tuning chamber 24. The imperforate conduit 40 is spot welded or otherwise operably coupled to the second partition wall 28 and/or the third partition wall 30 by conventional means. In this way, the imperforate conduit 40 structurally supports the second partition wall 28 and the third partition wall 30 such that only one of either the second partition wall 28 and the third partition wall 30 requires welding or other means of securing to the shell 12 to maintain stability.

Exhaust gasses are also transferred from the expansion chamber 20 through a perforated pipe 46 which is passed through a second partition wall perforated pipe aperture 48 and a third partition wall pipe aperture 50. The perforated pipe 46 is supported by the second partition wall 28 and/or the third partition wall 30 such that it extends across the attenuating chamber 22. The perforated pipe 46 is spot welded or otherwise operably coupled to the second partition wall 28 and the third partition wall 30 by conventional means. The perforated pipe 46 communicates with the attenuating chamber 22 through a plurality of holes 54.

Figure 3:
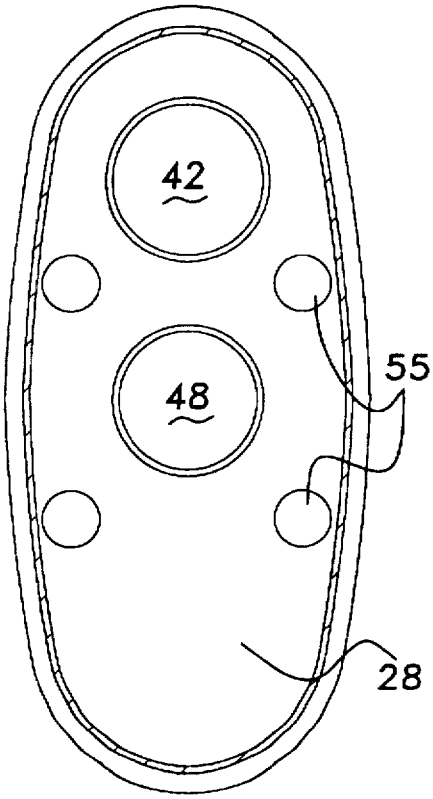
FIG. 3 is a sectional view taken along line 3—3 of FIG. 1.
Figure 4:
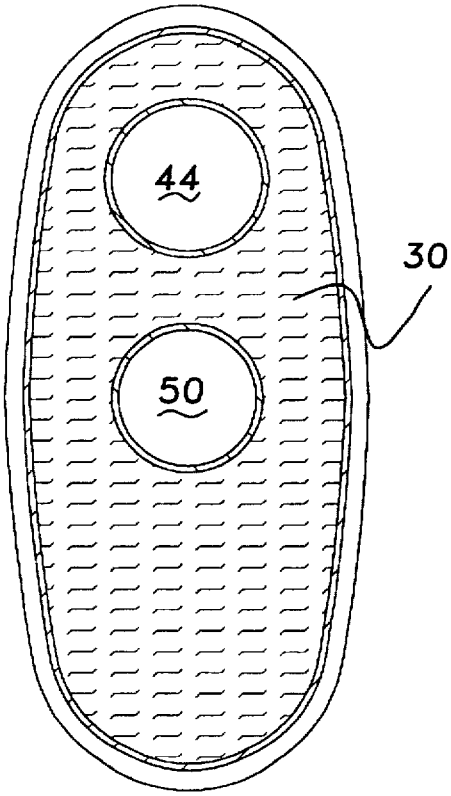
FIG. 4 is a sectional view taken along line 4—4 of FIG. 1.

As best seen in FIG. 3, the second partition wall 28 includes a plurality of passages formed therethrough including the imperforate conduit aperture 42 and the perforated pipe aperture 48. Also included are four openings 55 for facilitating the depositing of a sound absorption material described below in the attenuating chamber 22. The imperforate conduit aperture 44 and pipe aperture 50 of the third partition wall 30 are shown in a plan view in FIG. 4.

Returning to FIG. 1, in order to emit the exhaust gasses from the muffler 10, an outlet 56 is passed through the third partition wall pipe aperture 50 and a rear end plate outlet aperture 60. The outlet 56 is supported by the third partition wall 30 and the rear end plate 16. The outlet 56 may be spot welded or otherwise operably coupled to the third partition wall 30 and/or the rear end plate 16 by conventional means. The outlet 56 is coupled to a second end 62 of the perforated pipe 46 such that exhaust gasses are delivered from the perforated pipe 46 to the outlet 56.

As noted above, a sound absorbing material 64 is disposed within the attenuating chamber 22. The sound absorbing material 64 may comprise any commonly used sound absorbing material but preferably comprises fiberglass roving. The amount of sound absorbing material may vary, but 40 grams per liter has been found particularly effective.

The exhaust gas flow and sound elimination effect produced by the muffler 10 is described below. The exhaust gas enters the shell 12 through the inlet 32 from a conventional exhaust pipe (not shown). The inlet 32 delivers the exhaust gas directly to the expansion chamber 20 (bypassing the first tuning chamber 18) where the exhaust gasses are expanded. The expansion chamber 20 also serves as a turn-around chamber to direct the exhaust gasses in a plurality of directions.

Within the expansion chamber 20, a portion of the exhaust gas is directed toward the imperforate conduit 40 and a portion of the exhaust gas is directed toward the first partition wall passage 38 and perforate pipe 46. Because the imperforate conduit 40 and the second tuning chamber 24 have a fixed volume, there is no net gas flow therethrough. Furthermore, because the tuning chamber 18 and first partition wall passage 38 have a fixed volume, the net gas flow rate therethrough is zero. However, according to this design, the imperforate conduit 40 and second tuning chamber 24 combine to form a first Helmholtz tuning chamber. Additionally, the first partition wall passage 38 and the first tuning chamber 18 combine to form a second Helmholtz tuning chamber. Both the first and second Helmholtz chambers function to attenuate exhaust gas noise frequencies generally below 500 hz. It should be noted that different frequency ranges can be targeted for attenuating by changing the length or diameter of the imperforate conduit 40 or the first partition wall passage 38.

It should be appreciated that the imperforate conduit 40 performs at least two independent functions. The imperforate conduit 40 allows for long length Helmholtz tuning tubes to increase the volume of the first Helmholtz tuning chamber since it is external of the second tuning chamber 24. Also, the imperforate conduit 40 structurally supports the first partition wall 46 and the second partition wall 28 as described above to make the muffler 10 more stable. The structural function of the imperforate conduit 40 facilitates manufacturing in that it keeps the second partition wall 28 linked to the third partition wall 30 as this "center section" is mounted within the shell 12 as a sub-assembly and prevents the partitions from buckling under the mounting pressure.

Referring again to the gas flow, a portion of the exhaust gasses passing through the perforated pipe 46 are emitted from the plurality of holes 54 into the attenuating chamber 22. This exhaust gas interacts with the sound absorbing material 64 which converts the sound energy into thermal energy. Some of this gas re-enters the perforated pipe 46 through the plurality of holes 54 and combines with the exhaust gasses therein. These gasses are then directed through the outlet 56 to an exterior of the muffler 10. The attenuating chamber 22, combined with the perforated pipe 46 and the sound absorbing material 64, functions to tune auto exhaust frequencies above 500 hz.

Figure 5:
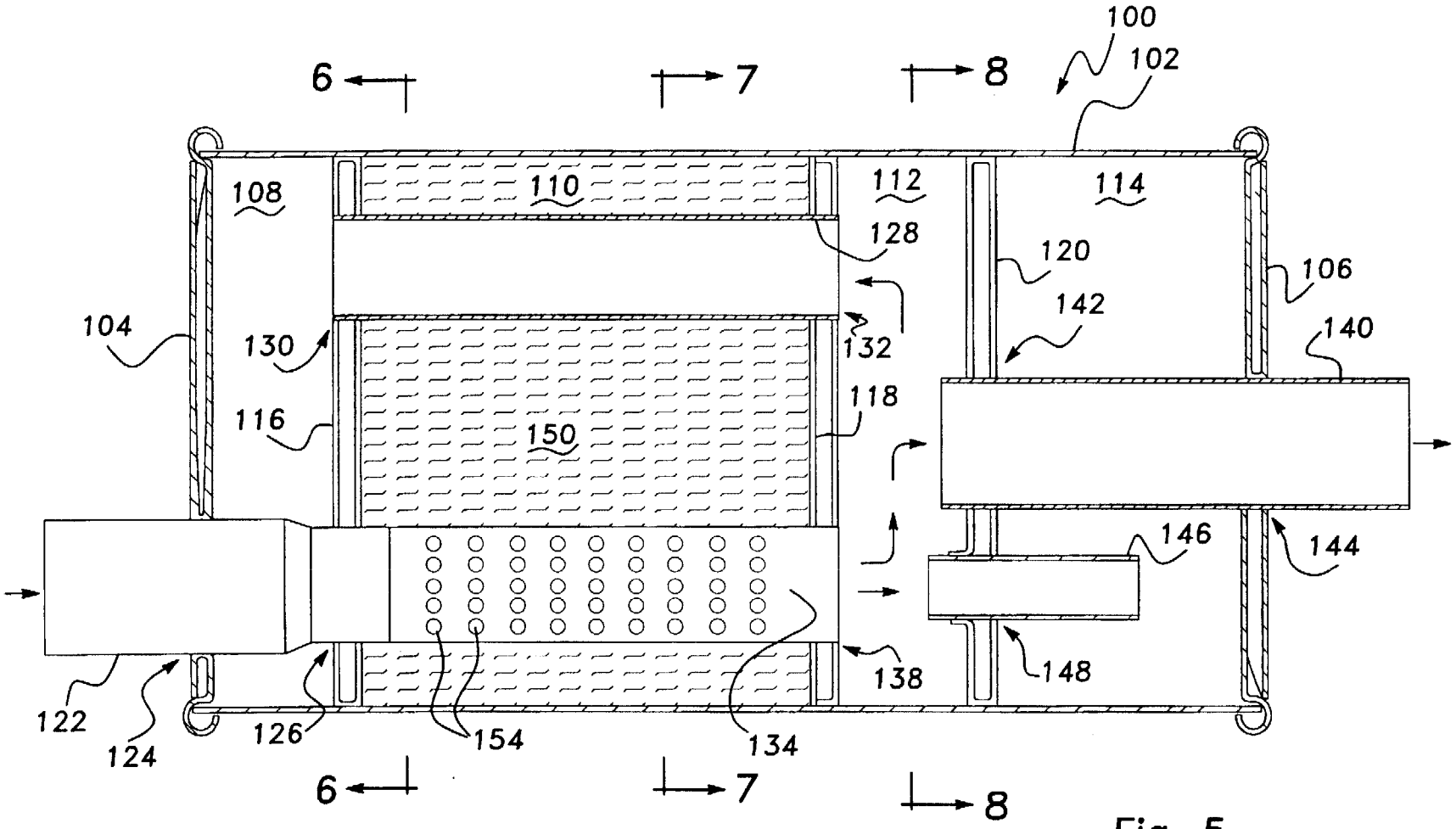
FIG. 5 is a top view of a muffler in cross-section including an attenuating chamber having a sound-absorbing material disposed therein and an imperforate pipe extending thereacross arranged according to the principles of a second embodiment of the present invention.

A second embodiment of the present invention is shown in FIG. 5. The muffler 100 has a cell defined by a cylindrical shell 102, a front end plate 104, and a rear end plate 106. The front end plate 104 and rear end plate 106 are preferably spot welded or otherwise secured to the shell 102 to close the interior of the muffler 100. The inside of the cell is divided into a plurality of chambers including a first tuning chamber 108, an attenuating chamber 110, an expansion chamber 112, and a second tuning chamber 114 by a plurality of partition walls.

The first partition wall 116 cooperates with the shell 102 and the front end plate 104 to define the first tuning chamber 108. The first tuning chamber 108 preferably has an inside volume of 1.5 liters. The first partition wall 116 cooperates with the shell 102 and the second partition wall 118 to define the attenuating chamber 110. The attenuating chamber 110 preferably has an inside volume of 4.5 liters. The second partition wall 118 cooperates with the shell 102 and the third partition wall 120 to define the expansion chamber 112. The expansion chamber 112 preferably has an inside volume of 1.7 liters. The third partition wall 120 cooperates with the shell 102 and the rear end plate 106 to define the second tuning chamber 114. The second tuning chamber 114 preferably has an inside volume of 3.0 liters.

In order to introduce exhaust gasses into the attenuating chamber 110, an inlet 122 is passed through a front end plate inlet aperture 124 and a first partition wall aperture 126 so that the inlet 122 leads to the attenuating chamber 110 beyond the first tuning chamber 108. The inlet 122 is supported by the front end plate 104 and the first partition wall 116. The inlet 122 is secured to the front end plate 104 and/or the first partition wall 116 by spot welding or other conventional means.

An imperforate conduit 128 is supported by the first partition wall 116 and the second partition wall 118 such that it extend across the attenuating chamber 110 and communicates directly with the expansion chamber 112. This is accomplished by passing the imperforate conduit 128 through a first partition wall imperforate conduit aperture 130 and a second partition wall imperforate conduit aperture 132. The imperforate conduit 128 is secured to the first partition wall 116 and/or to the second partition wall 118 by spot welding or other conventional means. In this way, the imperforate conduit 128 links the first partition wall 116 to the second partition wall 118 such that only one of either the first partition wall 116 or the second partition wall 118 needs to be secured to the shell 102 to maintain proper dimensioning. Also, the imperforate conduit 128 allows the center section of the muffler 100 to be inserted within the shell 102 as a subassembly while preventing the first partition wall 116 and the second partition wall 118 from buckling under mounting pressure.

A perforate pipe 134 is supported by the first partition wall 116 and by the second partition wall 118 such that it extends across the attenuating chamber 110. This is facilitated by passing the perforate pipe 134 through the first partition wall aperture 126 and a second partition wall perforate pipe aperture 138. The perforate conduit 134 is secured to the first partition wall 116 and/or the second partition wall 118 by spot welding or other conventional means. The perforate pipe 134 is coupled to the inlet 122 such that gas flowing through the inlet 122 is transferred to the perforate pipe 134.

Figure 6:
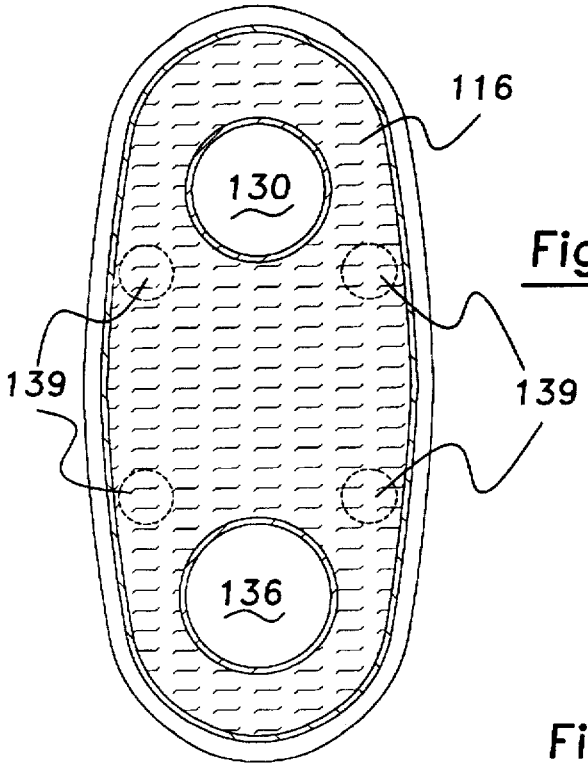
FIG. 6 is a sectional view taken along line 6—6 of FIG. 5.
Figure 7:
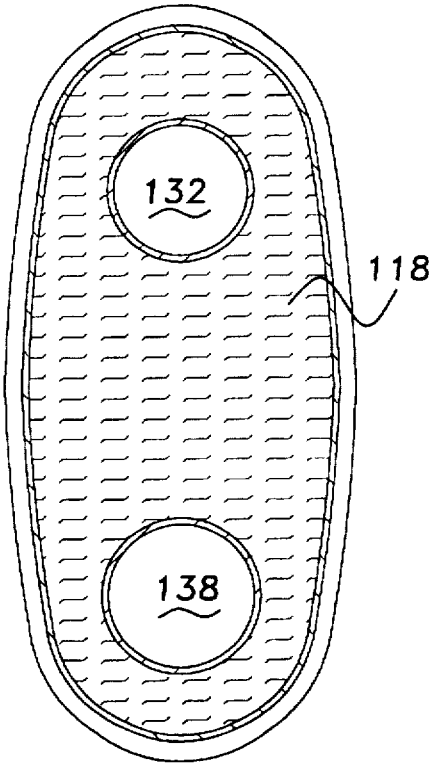
FIG. 7 is a sectional view taken along line 7—7 of FIG. 5.

As best seen in FIG. 6, the first partition wall 116 includes a plurality of openings formed therethrough including the imperforate conduit aperture 130 and the pipe aperture 136. Also included are four openings 139 for facilitating the depositing of a sound absorbing material described below within the attenuating chamber 110. The imperforate conduit aperture 132 and the perforate pipe aperture 138 of the second partition wall 118 are shown in a plan view in FIG. 7.

In order to emit exhaust gasses from the muffler 100, an outlet 140 is passed through a third partition wall aperture 142 and a rear end plate outlet aperture 144 such that the outlet 140 opens directly into the expansion chamber 112 beyond the second tuning chamber 114 such that the outlet 140 extends across the second tuning chamber 114. The outlet 140 is supported by the third partition wall 120 and the rear end plate 106. The outlet 140 is secured to the third partition wall 120 and/or the rear end plate 106 by spot welding or other conventional means.

Figure 8:
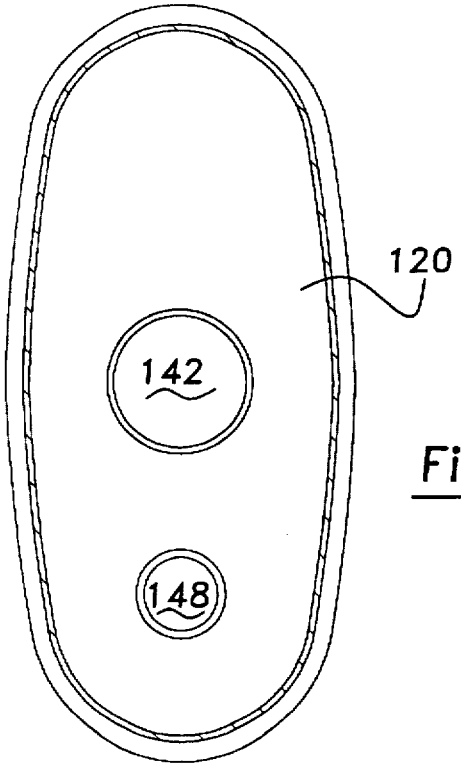
FIG. 8 is a sectional view taken along line 8—8 of FIG. 5.

A tuning pipe 146 is supported by the third partition wall 120 to enable communication between the expansion chamber 112 and the second tuning chamber 114. This is facilitated by passing the tuning pipe 146 through a third partition wall tuning pipe passage 148. The length and diameter of the tuning pipe 146 can be altered to change the attenuating frequency of the second tuning chamber 114 as described in greater detail below. The aperture 142 and passage 148 of the third partition wall 120 are shown in plan view in FIG. 8.

As noted above, a sound absorbing material 150 such as fiberglass is disposed within the attenuating chamber 110. Depositing of the sound absorbing material 150 within the attenuating chamber 110 is facilitated by the plurality of openings 139 in the first partition wall 116 which interconnect the first tuning chamber 108 and the attenuating chamber 110.

The exhaust gas flow and sound elimination effect produced by the second embodiment of the present invention is described below. Exhaust gasses enter the muffler 100 through the inlet 122 which delivers the exhaust gasses to the perforate pipe 134. A portion of the exhaust gasses is emitted from the perforate conduit 134 through the plurality of holes 154. This exhaust gas interacts with the sound absorbing material 150 disposed in the attenuating chamber 110. A portion of this gas then re-enters the perforate pipe 134 through the plurality of holes 154, combines with the gasses therein and is delivered to the expansion chamber 112 where the gasses are expanded.

A portion of the gasses in the expansion chamber 112 is directed towards the imperforate conduit 128. However, since the volume of the imperforate conduit 128 and the first tuning chamber 108 is fixed, the net gas flow therethrough is zero. Also, a portion of the gas in the expansion chamber is directed towards the tuning pipe 146 and second tuning chamber 114. However, since the volume of the tuning pipe 146 and second tuning chamber 114 is also fixed, the net gas flow therethrough is zero. The remaining gas within the expansion chamber 112 flows to the outlet 140 and is discharged from the muffler 100.

The first tuning chamber 108 and the imperforate conduit 128 combine to form a first Helmholtz tuning chamber for attenuating exhaust gas noises at frequencies less than 500 hz. The imperforate conduit 128 functions to increase the volume of the first Helmholtz tuning chamber by being placed externally of the first tuning chamber 108. As noted above with respect to the first embodiment, by varying the length and/or diameter of the imperforate conduit 128, the frequencies attenuated by the first Helmholtz chamber can be modified.

Furthermore, the tuning pipe 146 and second tuning chamber 114 combine to form a second Helmholtz tuning chamber for attenuating exhaust gas noise at frequencies less than 500 hz. By varying the length and/or diameter of the tuning pipe 146 (or by removing it from the third partition wall tuning pipe passage 148) the target frequency of attenuation may be modified.

The perforate pipe 134 and the sound absorbing material 150 within the attenuating chamber 110 function to attenuate exhaust gas noise at frequencies greater than 500 hz. In combination, the first Helmholtz chamber, the second Helmholtz chamber, and the attenuating chamber 110 combine to attenuate a broad range of exhaust gas noise frequencies without creating significant back pressure to the engine.

Accordingly, the present invention has the ability to tune-out exhaust gas noises over a wide range of frequencies while generating a very low amount of back pressure to the engine. Prior to the present invention, only mufflers creating much higher back pressure were able to attenuate the range of frequencies attenuatable by the present invention. Furthermore, reducing the level of back pressure increases the available horsepower from the engine to thereby provide better vehicle performance.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification, and following claims.

What is claimed is:

1. An attenuating apparatus comprising:

a shell;

first and second spaced apart walls coupled to said shell so as to define a first chamber;

a sound absorbing material disposed in said first chamber;

an imperforate conduit supported by said first and second walls and extending through said first chamber;

a third wall coupled to said shell in spaced relation to said first wall so as to define a second chamber, said imperforate conduit communicating with said second chamber;

a fourth wall coupled to said shell in spaced relation to said second wall so as to define a third chamber, said imperforate conduit communicating with said third chamber;

a fifth wall coupled to said shell in spaced relation to said fourth wall so as to define a fourth chamber, said forth chamber communicating with said third chamber, and a perforated conduit supported by said first and second walls and extending through said first chamber.

2. The apparatus of claim 1, further comprising:

a conduit supported by said first wall and third wall and extending through said second chamber.

3. The apparatus of claim 1, further comprising:

a conduit supported by said fourth wall and fifth wall and extending through said fourth chamber.

4. The apparatus of claim 1, further comprising:

a tuning conduit extending through said fourth wall and interconnecting said third chamber and said fourth chamber.

5. An acoustic muffler for attenuating sound waves comprising:

a shell;

a plurality of walls coupled to said shell, said plurality of walls closing both ends of said shell and dividing an interior of said shell into a plurality of chambers;

said plurality of chambers including an attenuating chamber having a sound absorbing material disposed therein, an expansion chamber adjacent said attenuating chamber, a first tuning chamber adjacent said attenuating chamber on an opposite side as said expansion chamber, and a second tuning chamber adjacent said expansion chamber and communicating therewith;

an imperforate pipe supported by a pair of said plurality of defining said attenuating chamber and extending therethrough, said imperforate pipe communicating with said expansion chamber and said first tuning chamber.

6. The acoustic muffler of claim 5, further comprising:

an inlet supported by a pair of said plurality of walls defining said first tuning chamber;

a perforated pipe supported by said pair of said plurality of walls defining said attenuating chamber, said perforated pipe being coupled to said inlet;

an outlet supported by a pair of said plurality of walls defining said second tuning chamber; and a tuning conduit supported by one of said plurality of walls and interconnecting said expansion and second tuning chambers.

7. An acoustic muffler for attenuating sound waves from exhaust gases of an internal combustion engine comprising:

a shell;

a front and a rear end plate coupled to said shell and closing both ends of said shell;

at least three partition walls coupled to said shell interior of said front and rear end plates, said three partition walls dividing an inside space of said shell into a plurality of chambers including and attenuating chamber, a first helmholtz tuning chamber adjacent said attenuating chamber, an expansion chamber adjacent said attenuating chamber on an opposite side as said first tuning chamber and a second helmholtz tuning chamber adjacent said expansion chamber;

an imperforate pipe supported by a pair of said at least three partition walls defining said attenuating chamber, said imperforate pipe communicating with said expansion chamber and said first tuning chamber; and a sound absorbing material disposed in said attenuating chamber.

8. The acoustic muffler of claim 7, further comprising:

an inlet pipe supported by said front end plate and a first of said partition walls, said inlet pipe extending through said first tuning chamber and communicating with said attenuating chamber;

a perforated pipe supported by said first partition wall and a second of said partition walls, said perforated pipe communicating with and said expansion chamber while extending through said attenuating chamber;

said perforated pipe being coupled to said inlet pipe;

an outlet pipe supported by a third of said partition walls and said rear end plate, said outlet pipe extending through said second tuning chamber; and said third partition wall including at least one tuning conduit interconnecting said expansion chamber and said second tuning chamber.

9. The acoustic muffler of claim 7, wherein said sound absorbing material comprises fiberglass roving.

10. An acoustic muffler for attenuating sound waves from exhaust gases of an internal combustion engine comprising:

a shell;

front and rear end plates coupled to said shell and closing both ends of said shell;

at least three partition walls coupled to said shell interior of said front and rear end plates, said three partition walls dividing an inner volume of said shell into a plurality of chambers including an attenuating chamber and pair of helmholtz tuning chambers oppositely disposed on either side of said attenuating chamber; and a sound absorbing material disposed in said attenuating chamber.

11. The acoustic muffler of claim 10, further comprising:

an imperforate pipe supported by a first and second of said at least three partition walls and extending through said attenuating chamber and communicating with said first helmholtz chamber; and a perforated pipe supported by said first and second partition walls and extending through said attenuating chamber.

12. The acoustic muffler of claim 10 wherein said first helmholtz chamber further comprises an imperforate pipe supported by a first and second wall of said at least three partition walls, said imperforate pipe extending through said attenuating chamber.

13. The acoustic muffler of claim 10 wherein said second helmholtz chamber further comprises:

a conduit extending through a third of said at least three partition walls, said conduit communicating with an expansion chamber adjacent said attenuating chamber.

* * * * *

UNITED STATES PATENT AND TRADEMARK OFFICE

CERTIFICATE OF CORRECTION

PATENT NO. : 5,783,782

DATED : July 21, 1998

INVENTOR(S) : Dale E. Sterrett et al.

It is certified that error appears in the above-identified patent and that said Letters Patent is hereby corrected as shown below:

Column 5, Line 42, "extend" should be --extends--.

Column 7, Line 55, Claim 1, after "chamber" delete "," and insert --;--.

Column 8, Line 15, Claim 5, before "defining" insert --walls--;

Column 8, Line 38, Claim 7, "and" should be --an--;

Column 8, Line 57, Claim 8, after "with" insert --said attenuating chamber--.

Signed and Sealed this

Ninth Day of February, 1999

*Attest:*

*Attesting Officer*

*Acting Commissioner of Patents and Trademarks*